US010094117B2

(12) United States Patent
Huang

(10) Patent No.: US 10,094,117 B2
(45) Date of Patent: Oct. 9, 2018

(54) VENTILATION ROOF

(71) Applicant: Daniel Huang, Taichung (TW)

(72) Inventor: Daniel Huang, Taichung (TW)

( * ) Notice: Subject to any disclaimer, the term of this patent is extended or adjusted under 35 U.S.C. 154(b) by 222 days.

(21) Appl. No.: 15/247,979

(22) Filed: Aug. 26, 2016

(65) Prior Publication Data

US 2016/0362895 A1 Dec. 15, 2016

(51) Int. Cl.
*E04D 13/04* (2006.01)
*E04D 13/17* (2006.01)

(52) U.S. Cl.
CPC ..... *E04D 13/0481* (2013.01); *E04D 13/17* (2013.01); *E04D 2013/045* (2013.01)

(58) Field of Classification Search
CPC ..... E04D 13/0481; E04D 13/17; E04D 2013/045; E04D 13/172; E04D 13/174; E04D 13/178; F24F 7/02
USPC ..... 52/198, 199, 302.1, 302.6; 454/364–366
See application file for complete search history.

(56) References Cited

U.S. PATENT DOCUMENTS 5,591,080 A * 1/1997 Ward ..... F24F 7/02 454/359
6,202,372 B1 * 3/2001 Powell ..... E04D 13/17 454/365
2005/0233691 A1 * 10/2005 Horton ..... E04D 13/17 454/366
2006/0172696 A1 * 8/2006 Cook ..... E04D 13/174 454/365
2007/0049190 A1 * 3/2007 Singh ..... E04D 13/17 454/365
2009/0227198 A1 * 9/2009 Yeh ..... F24F 7/025 454/358
2016/0130817 A1 * 5/2016 Huang ..... E04D 13/174 52/198

* cited by examiner

*Primary Examiner* — William V Gilbert

(57) ABSTRACT

A device mounted on a roof is provided with, in one embodiment, a first structural component including a first water guide board on the roof and inclined upward, the first water guide board having a groove at a downward bent open end; a vent under the first water guide board; a second structural component including a downward inclined second water guide board extending toward the first water guide board; a splash elimination wall under the groove and abutted on the vent; and a water blocking board secured to a bottom of the first structural component and abutted on the vent.

1 Claim, 14 Drawing Sheets

VENTILATION ROOF

BACKGROUND OF THE INVENTION

1. Field of the Invention

The invention relates to roofs and more particularly to a roof having a device capable of admitting light, inhibiting the ingress of rain water, and slowing the flowing rain water falling on the roof.

2. Description of Related Art

A first conventional roof 1A' is schematically shown in FIG. 1A. Unfortunately, rain water (as indicated by arrows) may enter the building through gaps between a first sloping side 11' and a second sloping side 12' and a vent 20' when rain is heavy.

A second conventional roof 1B' is schematically shown in FIG. 1B. Unfortunately, rain water (as indicated by arrows) may enter the building through gaps between a first sloping side 11' and a second sloping side 12' and a vent 20' when rain is heavy.

A third conventional roof 1C' is schematically shown in FIGS. 1C and 1D. Water guide members 13', splash prevention boards 15', a first sloping side 11', a second sloping side 12' and corrugated roof boards 2' are provided along the length L of roof 1C'. Unfortunately, rain water may still enter the building as indicated by arrows when rain is heavy.

A fourth conventional roof 1D' is schematically shown in FIG. 1E. Unfortunately, rain water may enter the building through gaps between a first sloping side 11' and a second sloping side 12' and a vent (not numbered) when rain is heavy. Further, sunlight is not admitted to the building as indicated by arrows.

A fifth conventional roof 1E' is schematically shown in FIG. 1F. Fortunately, sunlight is admitted to the building through a channel as indicated by arrows. However, its ventilation is poor. Further, the channel occupies space and its construction cost is relatively high.

Thus, the need for improvement still exists.

SUMMARY OF THE INVENTION

It is therefore one object of the invention to provide a roof device mounted on a roof, comprising a first structural component including a first water guide board on the roof and inclined upward, the first water guide board having a groove at a downward bent open end; a vent under the first water guide board; a second structural component including a downward inclined second water guide board extending toward the first water guide board; a splash elimination wall disposed under the groove and abutted on the vent; and a water blocking board secured to a bottom of the first structural component and abutted on the vent.

By utilizing the invention, it is capable of admitting light, inhibiting the ingress of rain water, and most importantly slowing the flowing rain water falling on the roof.

The above and other objects, features and advantages of the invention will become apparent from the following detailed description taken with the accompanying drawings.

DETAILED DESCRIPTION OF THE INVENTION

Figure 1A:
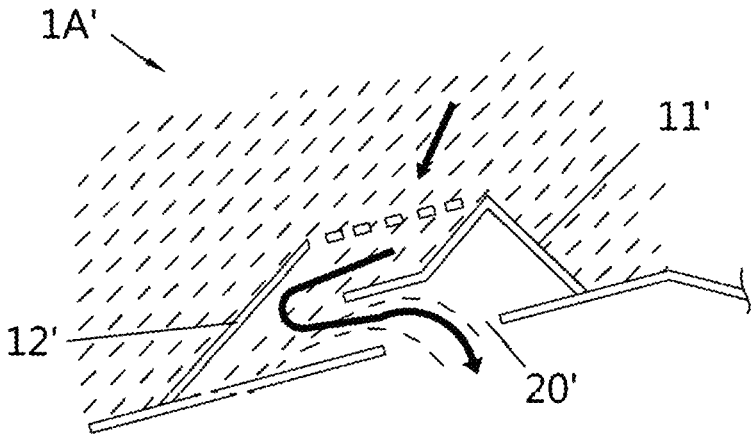
FIG.1A Prior Art
FIG. 1A schematically depicts problems associated with a first conventional roof.
Figure 1B:
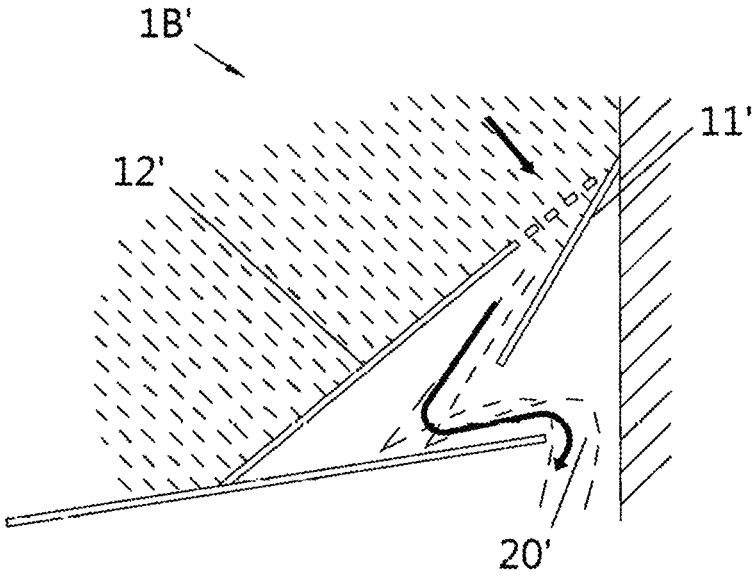
FIG.1B Prior Art
FIG. 1B schematically depicts problems associated with a second conventional roof.
Figure 1D:
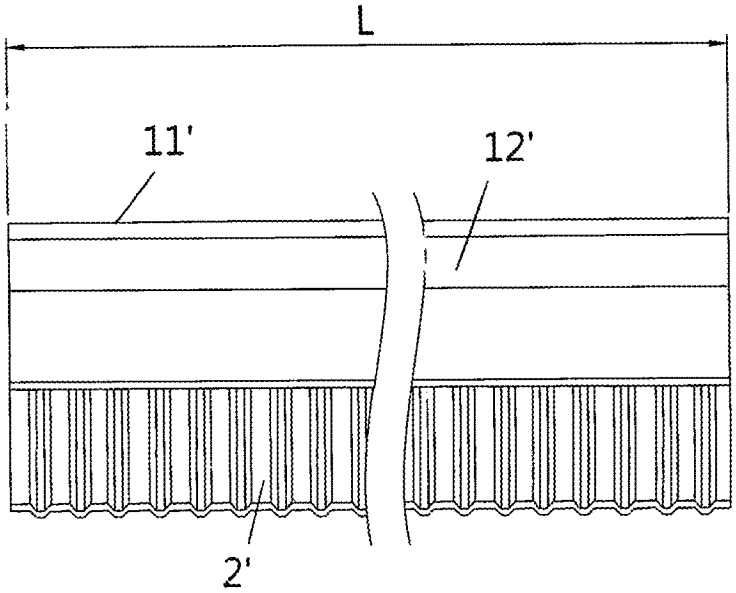
FIG.1D Prior Art
FIG. 1D is a schematic top view of FIG. 1C.
Figure 1C:
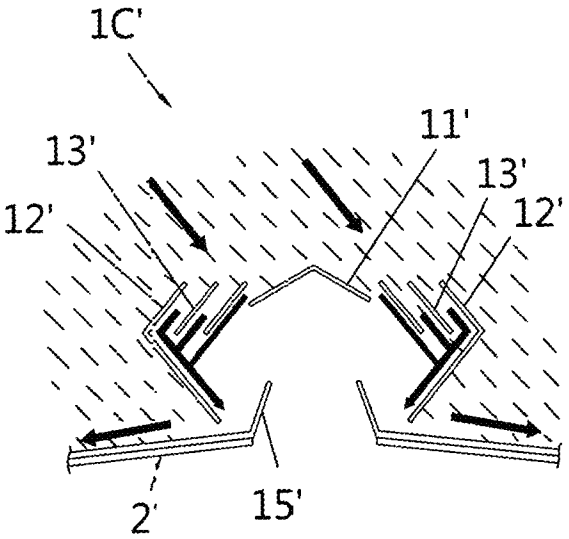
FIG.1C Prior Art
FIG. 1C schematically depicts problems associated with a third conventional roof.
Figure 1E:
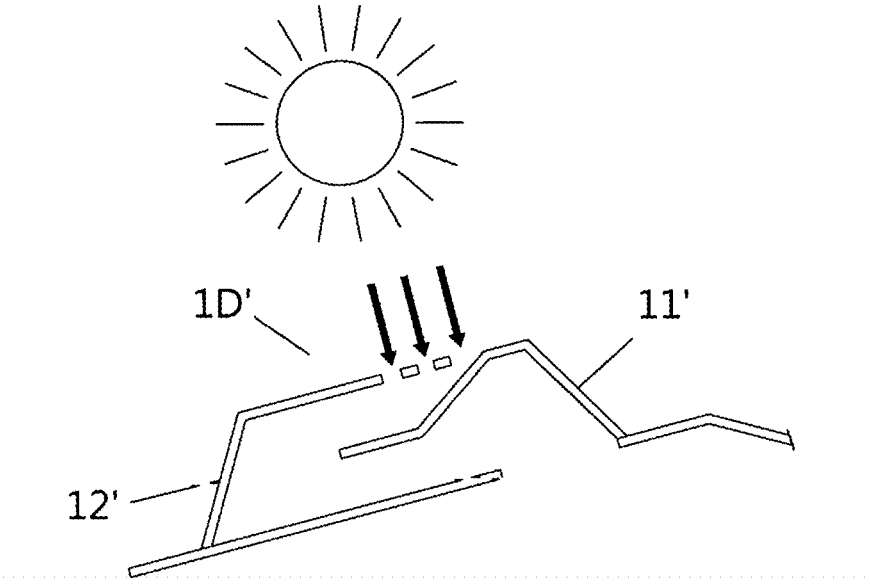
FIG.1E Prior Art
FIG. 1E schematically depicts problems associated with a fourth conventional roof.
Figure 1F:
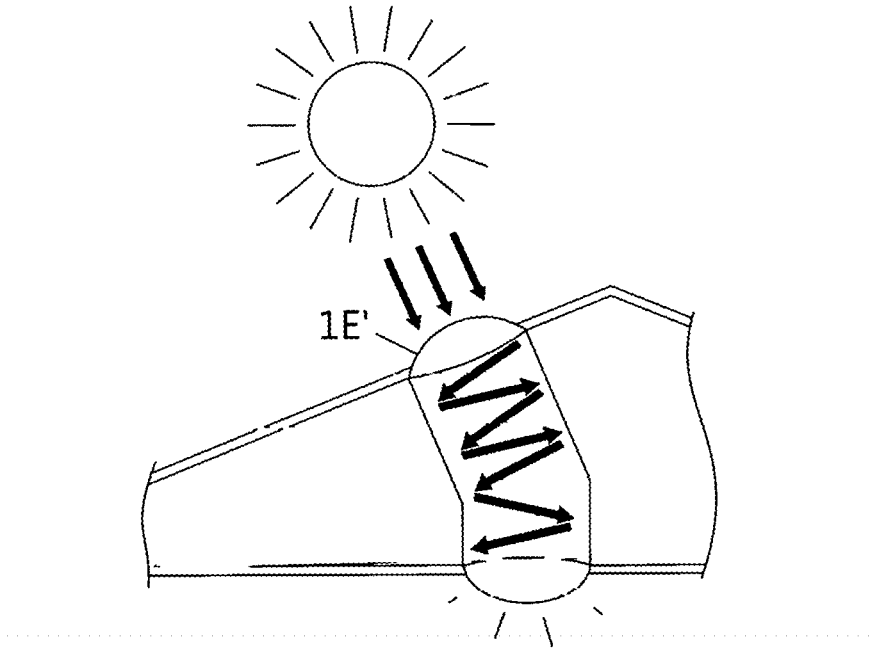
FIG.1F Prior Art
FIG. 1F schematically depicts problems associated with a fifth conventional roof.
Figure 2A:
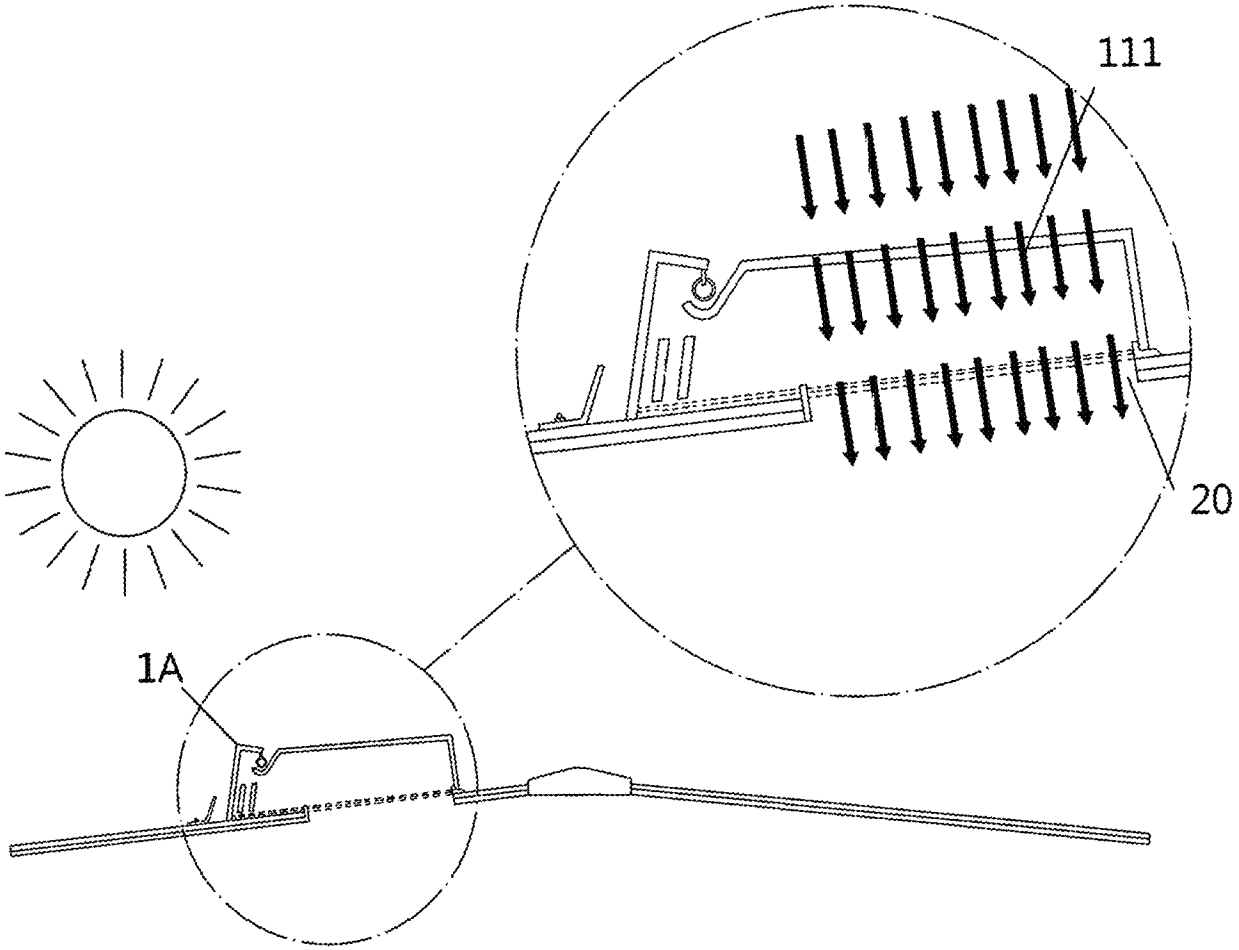
FIG. 2A schematically depicts a device mounted on a roof according to a first preferred embodiment of the invention, the device being capable of admitting light.
Figure 2B:
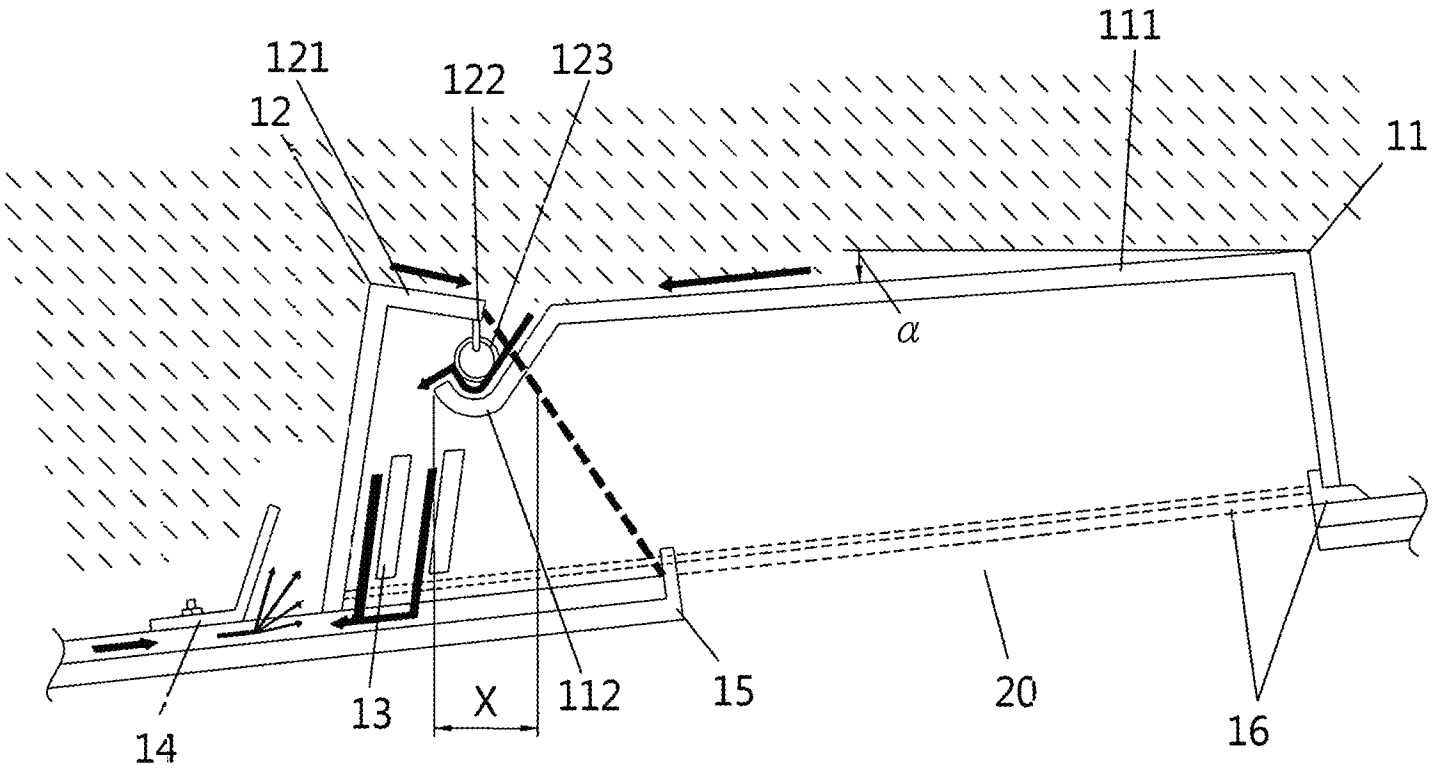
FIG. 2B schematically depicts the device of FIG. 2A being capable of further inhibiting the ingress of rain water.

Referring to FIGS. 2A and 2B, a device 1A is mounted on a roof according to a first preferred embodiment of the invention.

In FIG. 2A, the device 1A includes a transparent first water guide board 111 of a first structural component 11 and a vent 20 under the first water guide board 111. It is envisaged by the invention that light is admitted into a building having the roof through the transparent first water guide board 111 and the vent 20.

In FIG. 2B, the first water guide board 111 is inclined downward at an angle $\alpha$ with respect to a horizontal line and the device 1A further comprises a groove 112 at a downward bent open end of the first water guide board 111, a second structural component 12 including a downward inclined second water guide board 121 extending toward the first water guide board 111, the second water guide board 121 having a suspension member 122 at an open end above the groove 112, and a water buffer pipe 123 secured to the suspension member 122 and disposed between the suspension member 122 and the groove 112, two water guide members 13 under both the groove 112 and the second water guide board 121, a water guide element 14 disposed externally of the second structural component 12, a splash elimination wall 15 under the groove 112 and abutted on the vent 20, and a water blocking board 16 secured to a bottom of the first structural component 11 and abutted on the vent 20. The groove 112 has a width of X. It is envisaged by the invention that rain water is guided out of the roof of the building (i.e., inhibiting the ingress of rain water) by passing the downward inclined first and second water guide boards 111 and 121, the groove 112, the water guide members 13 and the water guide element 14.

Figure 3A:
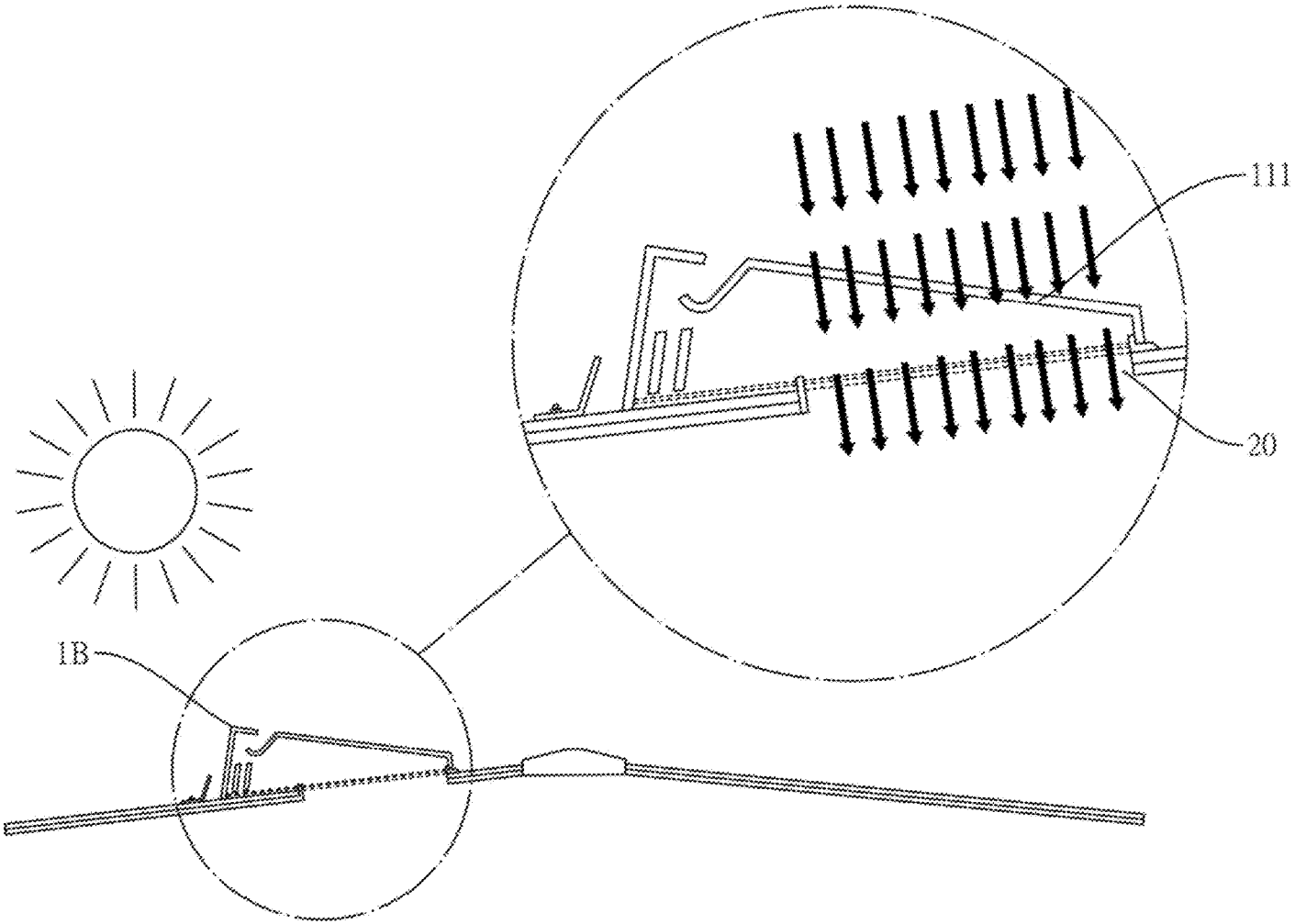
FIG. 3A schematically depicts a device mounted on a roof according to a second preferred embodiment of the invention, the device being capable of admitting light.
Figure 3B:
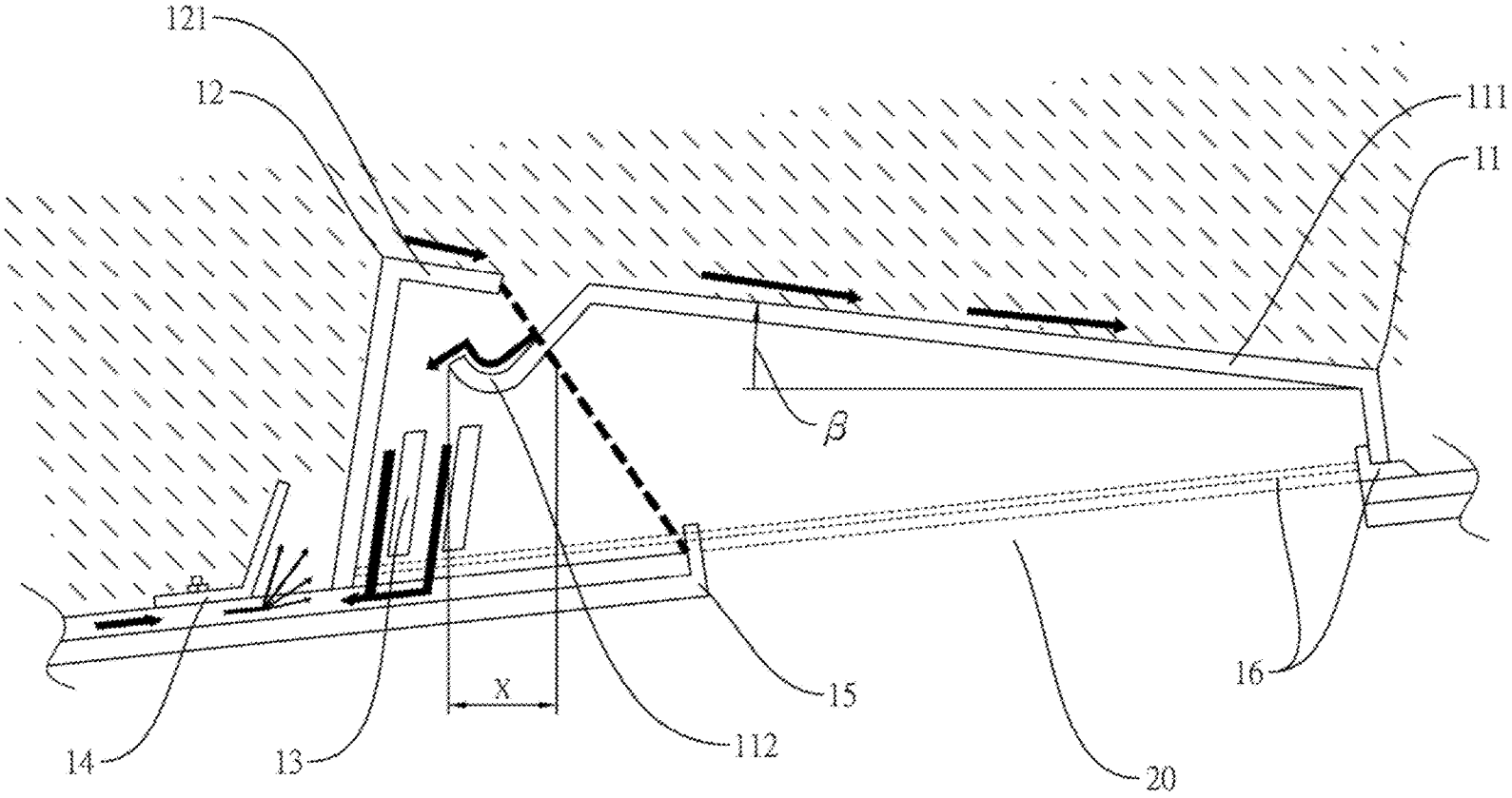
FIG. 3B schematically depicts the device of FIG. 3A being capable of further inhibiting the ingress of rain water.

Referring to FIGS. 3A and 3B, a device 1B is mounted on a roof according to a second preferred embodiment of the invention.

In FIG. 3A, the device 1B includes a transparent first water guide board 111 of a first structural component 11 and a vent 20 under the first water guide board 111. It is envisaged by the invention that light is admitted into a building having the roof through the transparent first water guide board 111 and the vent 20.

In FIG. 3B, the first water guide board 111 is inclined upward at an angle β with respect to a horizontal line and the device 1B further comprises a groove 112 at a downward bent open end of the first water guide board 111, a second structural component 12 including a downward inclined second water guide board 121 extending toward the first water guide board 111, the second water guide board 121 having a suspension member 122 at an open end above the groove 112, and a water buffer pipe 123 secured to the suspension member 122 and disposed between the suspension member 122 and the groove 112, two water guide members 13 under both the groove 112 and the second water guide board 121, a water guide element 14 disposed externally of the second structural component 12, a splash elimination wall 15 under the groove 112 and abutted on the vent 20, and a water blocking board 16 secured to a bottom of the first structural component 11 and abutted on the vent 20. The groove 112 has a width of X. It is envisaged by the invention that rain water is guided out of the roof of the building (i.e., inhibiting the ingress of rain water) in one direction by passing the upward inclined first water guide board 111 and in an opposite direction by passing the downward inclined second water guide board 121, the groove 112, the water guide members 13 and the water guide element 14.

Figure 4A:
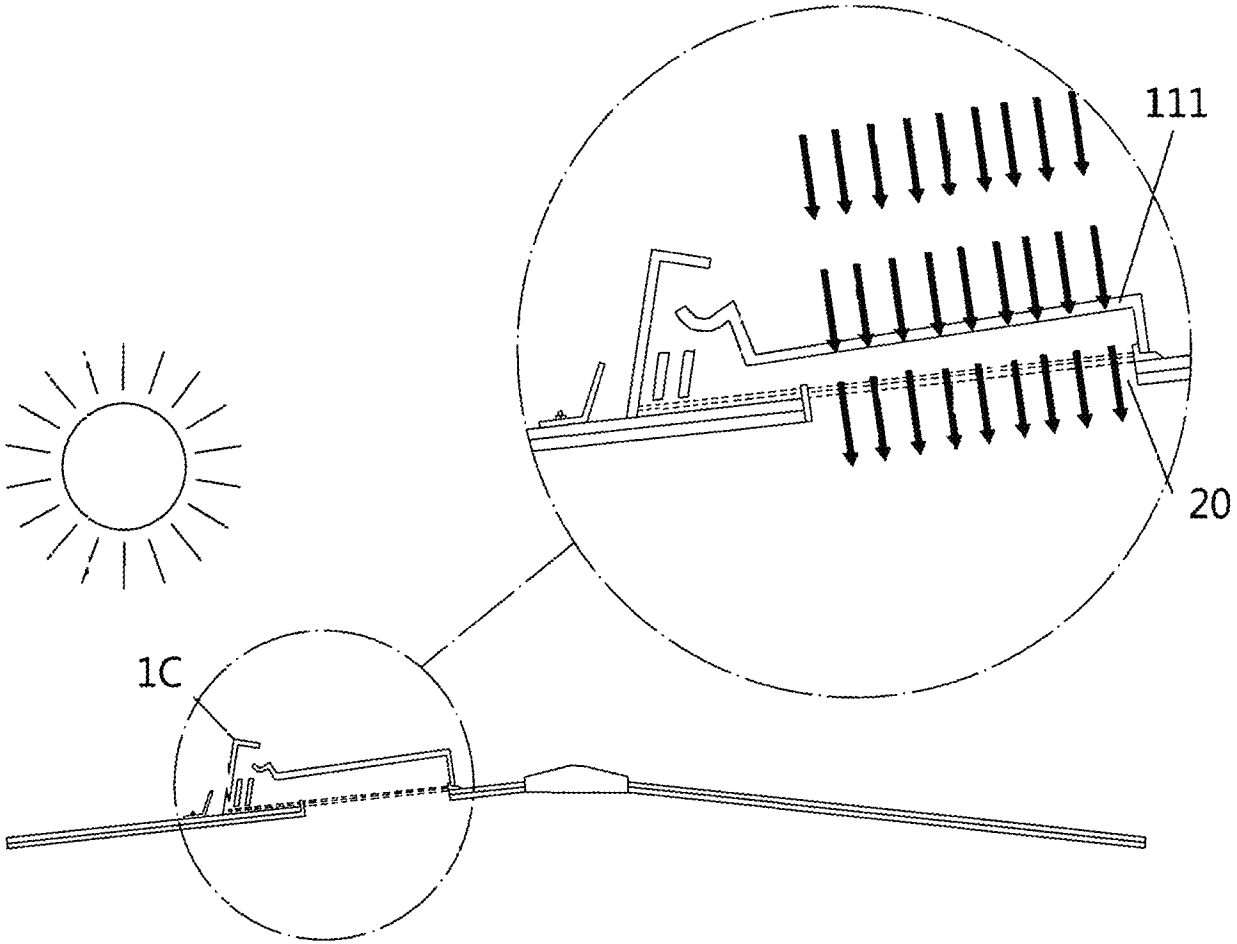
FIG. 4A schematically depicts a device mounted on a roof according to a third preferred embodiment of the invention, the device being capable of admitting light.
Figure 4B:
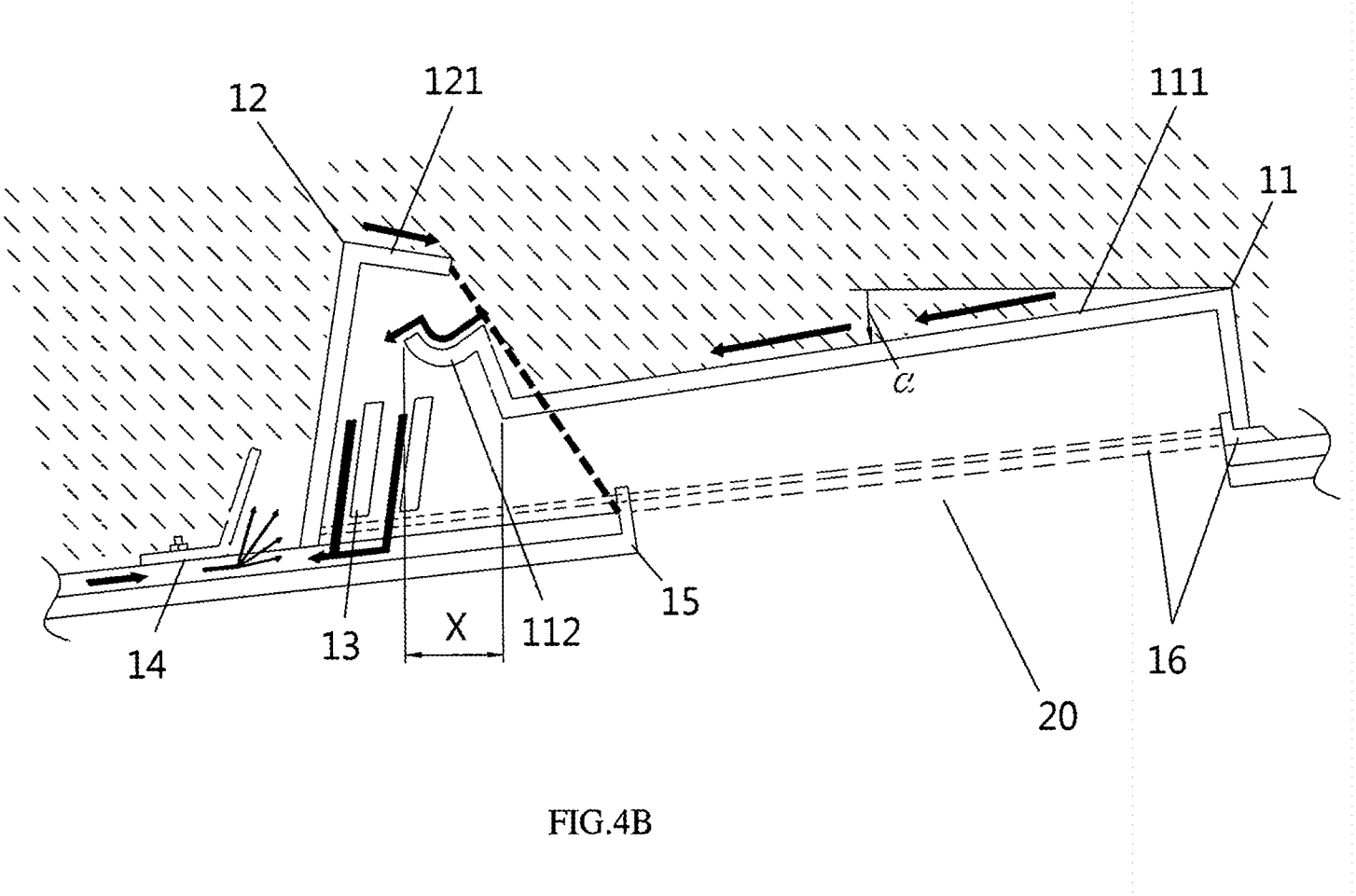
FIG. 4B schematically depicts the device of FIG. 4A being capable of further inhibiting the ingress of rain water.

Referring to FIGS. 4A and 4B, a device 1C is mounted on a roof according to a third preferred embodiment of the invention.

In FIG. 4A, the device 1A includes a transparent first water guide board 111 of a first structural component 11 and a vent 20 under the first water guide board 111. It is envisaged by the invention that light is admitted into a building having the roof through the transparent first water guide board 111 and the vent 20.

In FIG. 4B, the first water guide board 111 is inclined downward at an angle α with respect to a horizontal line and the device 1A further comprises a groove 112 at an upward bent open end of the first water guide board 111, a second structural component 12 including a downward inclined second water guide board 121 extending toward the first water guide board 111, two water guide members 13 under both the groove 112 and the second water guide board 121, a water guide element 14 disposed externally of the second structural component 12, a splash elimination wall 15 under the groove 112 and abutted on the vent 20, and a water blocking board 16 secured to a bottom of the first structural component 11 and abutted on the vent 20. The groove 112 has a width of X.

It is envisaged by the invention that rain water is guided out of the roof of the building (i.e., inhibiting the ingress of rain water) by passing the downward inclined first and second water guide boards 111 and 121, the groove 112 after rain water accumulated in the first water guide board 111 overflowing into the groove 112, the water guide members 13 and the water guide element 14. Moreover, the width X of the groove 12 should be sufficiently wide in order to achieve the above purpose and slow the flowing of rain water.

Figure 5A:
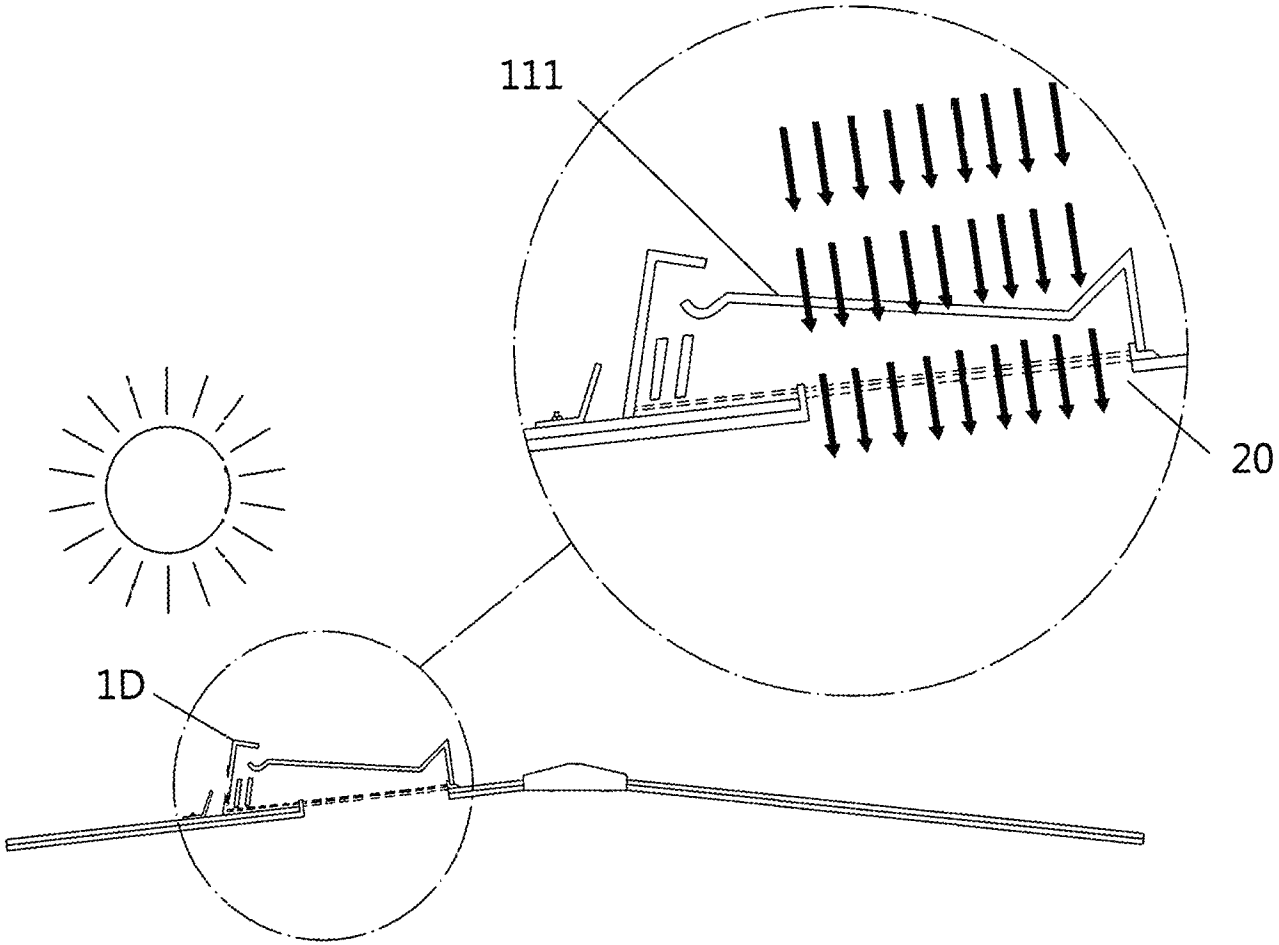
FIG. 5A schematically depicts a device mounted on a roof according to a fourth preferred embodiment of the invention, the device being capable of admitting light.
Figure 5B:
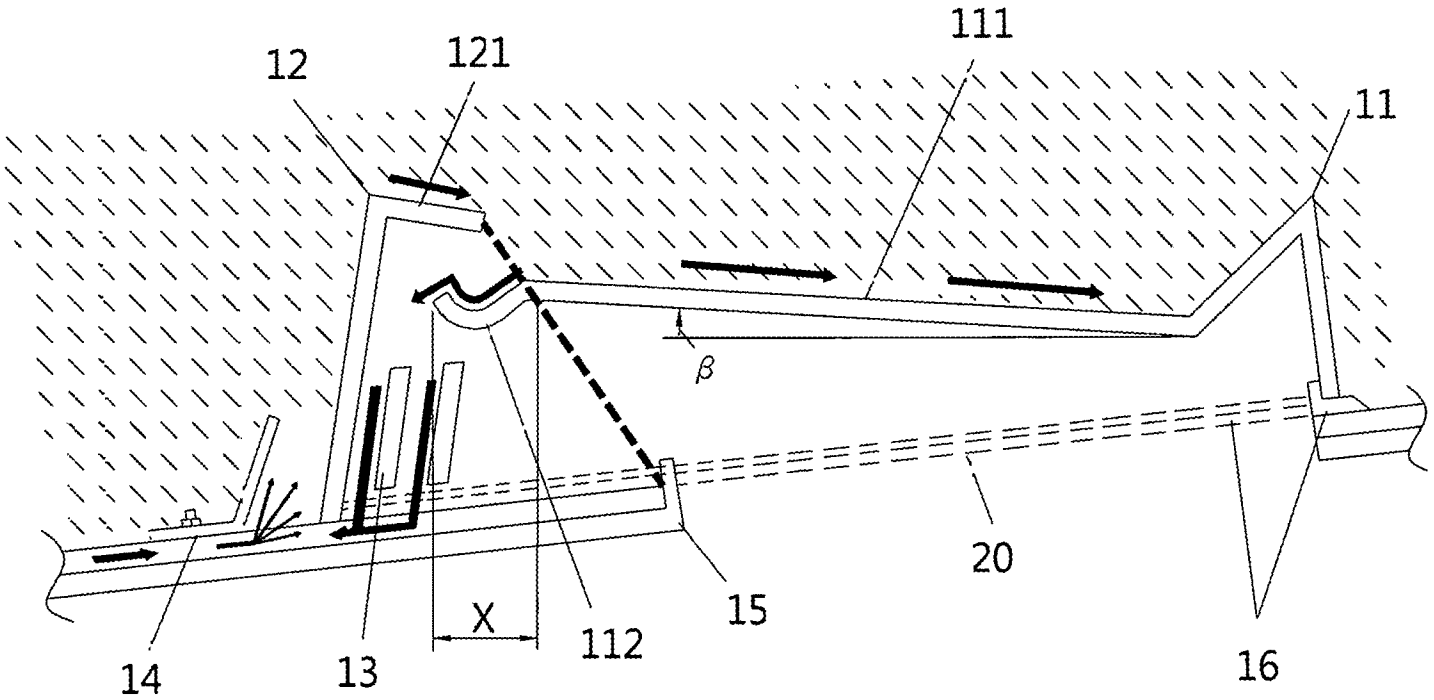
FIG. 5B schematically depicts the device of FIG. 5A being capable of further inhibiting the ingress of rain water.

Referring to FIGS. 5A and 5B, a device 1D is mounted on a roof according to a fourth preferred embodiment of the invention.

In FIG. 5A, the device 1D includes a transparent first water guide board 111 of a first structural component 11 and a vent 20 under the first water guide board 111. It is envisaged by the invention that light is admitted into a building having the roof through the transparent first water guide board 111 and the vent 20.

In FIG. 5B, the first water guide board 111 is inclined upward at an angle β with respect to a horizontal line and the first water guide board 111 is inclined upward at an end joined the first structural component 11. The device 1D further comprises a groove 112 at a downward bent open end of the first water guide board 111, a second structural component 12 including a downward inclined second water guide board 121 extending toward the first water guide board 111, the second water guide board 121 having a suspension member 122 at an open end above the groove 112, and a water buffer pipe 123 secured to the suspension member 122 and disposed between the suspension member 122 and the groove 112, two water guide members 13 under both the groove 112 and the second water guide board 121, a water guide element 14 disposed externally of the second structural component 12, a splash elimination wall 15 under the groove 112 and abutted on the vent 20, and a water blocking board 16 secured to a bottom of the first structural component 11 and abutted on the vent 20. The groove 112 has a width of X. It is envisaged by the invention that rain water is guided out of the roof of the building (i.e., inhibiting the ingress of rain water) by accumulating in the upward inclined first water guide board 111, overflowing to the groove 112 when the accumulated rain water in the upward inclined first water guide board 111 is sufficiently high in one portion; passing the downward inclined second water guide board 121 and the groove 112 in the other portion; and passing the water guide members 13 and the water guide element 14.

Figure 6:
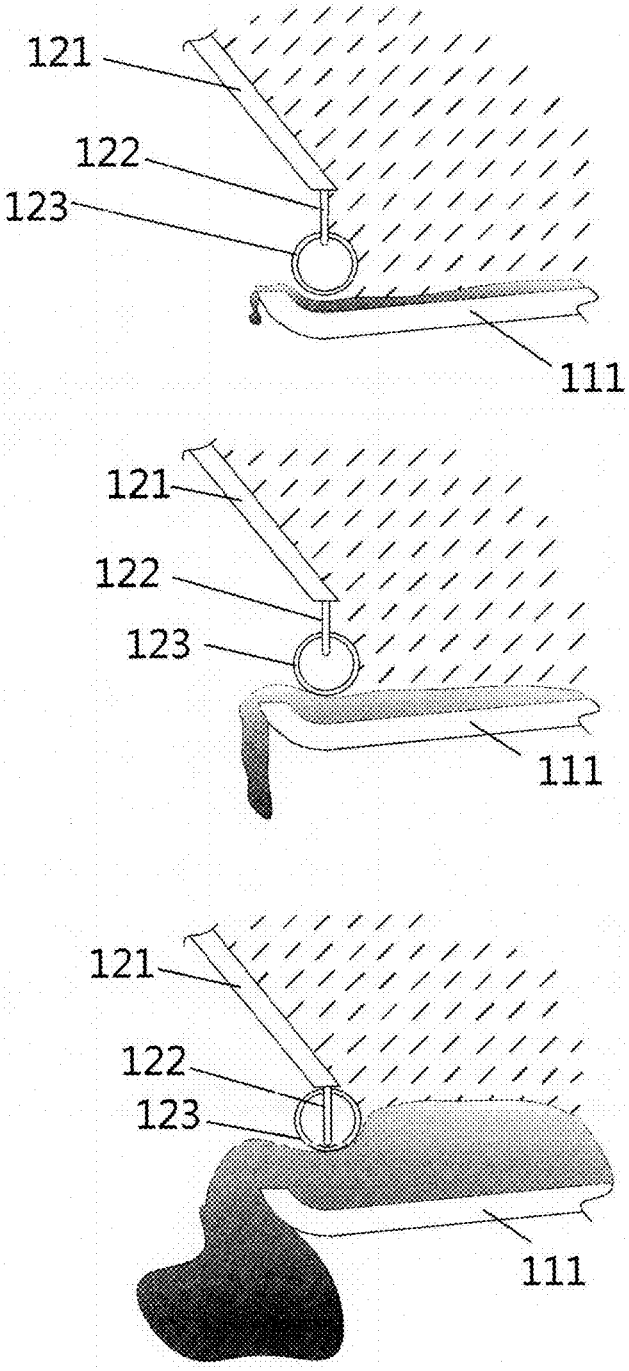
FIG. 6 schematically depicts rain water on the roof being slowed by the water buffer pipe according to the invention.
Figure 7:
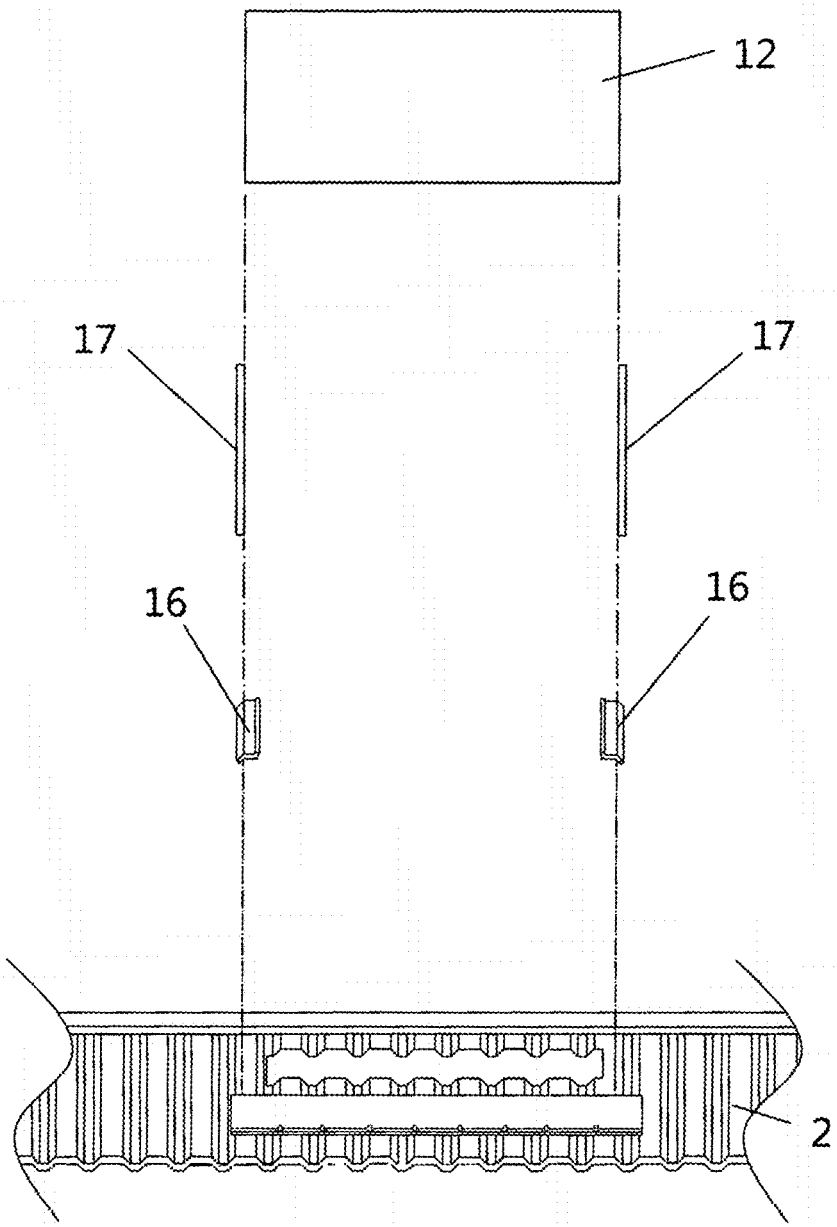
FIG. 7 schematically depicts rain water on the roof being prevented from entering the building by the water blocking board according to the invention.

Referring to FIG. 6, the water buffer pipe 123 has the effect of slowing the flowing of the rain water in the groove 112 when rain water accumulated in the groove 112 is small (see upper part), medium (see intermediate part), and large (see lower part). Referring to FIG. 7, each of the two water blocking boards 16 is mounted on the corrugated roof board 2 by means of a mounting board 17 which has an upper end secured to the second structural component 12.

Figure 8B:
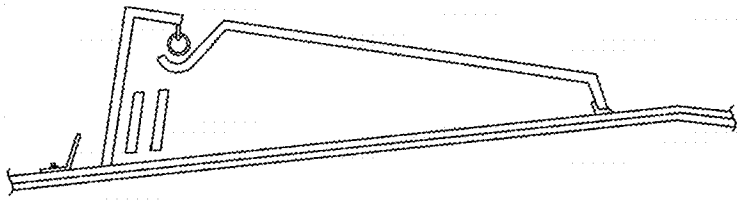
FIG. 8B further schematically depicts rain water on the roof being prevented from entering the building by the water blocking board according to the invention.
Figure 8A:
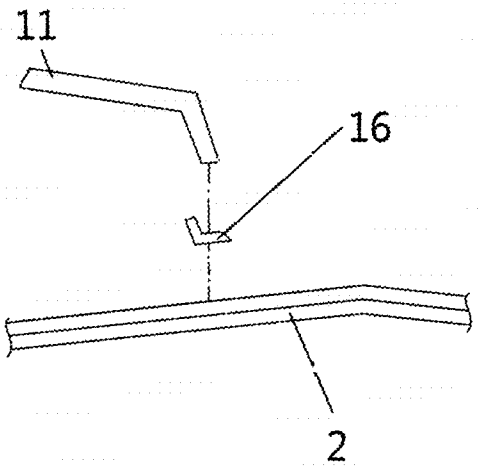
FIG. 8A schematically depicts the first structural component and the corrugated roof board to be joined by the water blocking board.

Referring to FIGS. 8A and 8B, the water blocking board 16 is mounted between the corrugated roof board 2 and the first structural component 11.

It is envisaged by the invention that the device is capable of admitting light, inhibiting the ingress of rain water, and most importantly slowing the flowing rain water falling on the roof.

While the invention has been described in terms of preferred embodiments, those skilled in the art will recognize that the invention can be practiced with modifications within the spirit and scope of the appended claims.

What is claimed is:

1. A device mounted on a roof, comprising:

a vent;

a first structural component comprising a first water guide board disposed on the roof, the first water guide board including a groove at a bent open end;

a second structural component comprising a second water guide board extending toward the first water guide board, the second water guide board including a suspension member at an open end, and a water buffer pipe secured to the suspension member and disposed between the suspension member and the groove;

a splash elimination wall abutted on the vent; and a water blocking board secured to the first structural component and abutted on the vent.

* * * * *